US010452005B2

(12) United States Patent
Tabata

(10) Patent No.: US 10,452,005 B2
(45) Date of Patent: Oct. 22, 2019

(54) IMAGE FORMING APPARATUS

(71) Applicant: CANON KABUSHIKI KAISHA, Tokyo (JP)

(72) Inventor: Yu Tabata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 15/397,178

(22) Filed: Jan. 3, 2017

(65) Prior Publication Data

US 2017/0205754 A1 Jul. 20, 2017

(30) Foreign Application Priority Data

Jan. 15, 2016 (JP) ..... 2016-005717
Dec. 14, 2016 (JP) ..... 2016-241864

(51) Int. Cl.
*G03G 15/16* (2006.01)

(52) U.S. Cl.
CPC ..... *G03G 15/1675* (2013.01); *G03G 15/1605* (2013.01); *G03G 2215/0132* (2013.01)

(58) Field of Classification Search
CPC ..... G03G 15/1605; G03G 15/80; G03G 2215/1623
See application file for complete search history.

(56) References Cited

FOREIGN PATENT DOCUMENTS

| | | | |
|---|---|---|---|
| JP | 08-292659 | A | 11/1996 |
| JP | 2005-316200 | A | 11/2005 |
| JP | 2006-251401 | A | 9/2006 |
| JP | 2007-256860 | A | 10/2007 |
| JP | 2014-071264 | A | 4/2014 |
| JP | 2015-072348 | A | 4/2015 |
| JP | 2015-232624 | A | 12/2015 |

*Primary Examiner* — Erika J Villaluna
(74) *Attorney, Agent, or Firm* — Venable LLP

(57) ABSTRACT

An image forming apparatus includes a belt member, a toner image forming unit, a first transfer roller, a second transfer roller provided at a position opposed to the first transfer roller with the belt member intervened and forming a transfer portion, and a power feed roller configured to abut against an outer circumferential surface of the first transfer roller to supply a current to a metal shaft of the first transfer roller. A width of a large diameter portion of the power feed roller with respect to a width direction intersecting a direction of movement of the belt member is equal to or greater than a maximum width of image formation and smaller than a width of a maximum size of the recording material.

20 Claims, 10 Drawing Sheets

IMAGE FORMING APPARATUS

BACKGROUND OF THE INVENTION

Field of the Invention

The present invention relates to an image forming apparatus.

Description of the Related Art

Conventionally, an intermediate transfer-type image forming apparatus is known, in which a toner image formed on a photosensitive drum is primarily transferred to an intermediate transfer belt, and the toner image formed on the intermediate transfer belt by primary transfer is secondarily transferred to the recording material. In this type of image forming apparatus, a transfer voltage is applied to a secondary transfer inner roller abutted against a secondary transfer outer roller with an intermediate transfer belt intervened and forming a secondary transfer portion, i.e., secondary transfer nip portion, by which secondary transfer is performed.

According to the above-described secondary transfer outer roller, an elastic layer is provided on a circumferential surface of a shaft portion having conductivity, and a conductive agent such as an ion conductive agent is dispersed in the elastic layer, giving conductivity to the elastic layer. In that case, however, along with the elapse of application time of transfer voltage, ions within the ion conductive agent polarize in a manner biased to a roller surface side or a shaft portion side, and electric resistance tends to be raised. When the electric resistance is raised, even if a same transfer voltage as before the resistance is raised is applied, it is difficult to supply the same amount of transfer current to the secondary transfer portion as before the resistance is raised. Therefore, in order to suppress the rising of electric resistance caused by polarization, for example, Japanese Unexamined Patent Application Publication No. 2005-316200 proposes an apparatus configured to supply current from a power feed roller abutted against a surface of a secondary transfer outer roller to a secondary transfer outer roller, which is referred to as external power feed, to transfer a toner image from an intermediate transfer belt to a recording material.

The image forming apparatus disclosed in the above-described Japanese Unexamined Patent Application Publication No. 2005-316200 adds the power feed roller to the secondary transfer unit in a state abutted against the secondary transfer outer roller, so that the secondary transfer unit may be increased in size compared to the conventional apparatus.

SUMMARY OF THE INVENTION

The present invention provides an image forming apparatus capable of suppressing the raise of electric resistance caused by polarization, while suppressing the increase in size of the secondary transfer unit in a configuration utilizing an external power feed.

According to a first aspect of the present invention, an image forming apparatus includes a belt member provided movably and configured to bear a toner image, a toner image forming unit configured to form the toner image on the belt member, a first transfer roller including a metal shaft and an elastic layer formed in a circumference of the metal shaft and containing a conductive agent, the first transfer roller being in contact with an external surface of the belt member and forming a transfer portion in which the toner image formed on the belt member is transferred to a recording material, a second transfer roller including a metal shaft and an elastic layer formed in a circumference of the metal shaft, the second transfer roller provided at a position opposed to the first transfer roller with the belt member intervened and forming the transfer portion, a power feed roller configured to abut against an outer circumferential surface of the first transfer roller to supply a current to the metal shaft of the first transfer roller, the power feed roller comprising a large diameter portion provided at a position corresponding to an image forming area, and small diameter portions arranged at both end portions of the power feed roller and having a smaller diameter than the large diameter portion by which the power feed roller is axially supported, and a power supply configured to form a potential gradient such that a potential of the metal shaft of the second transfer roller has opposite polarity as a charging polarity of toner, and to form a potential gradient such that a potential of the power feed roller has opposite polarity as the charging polarity of toner, in a state where the potential of the metal shaft of the first transfer roller is set as reference. A width of the large diameter portion of the power feed roller with respect to a width direction intersecting a direction of movement of the belt member is equal to or greater than a maximum width of image formation and smaller than a width of the elastic layer of the first transfer roller.

According to a second aspect of the present invention, an image forming apparatus includes a belt member configured to move and to bear a toner image, a toner image forming unit configured to form a toner image on the belt member, a first transfer roller including a metal shaft and an elastic layer formed on an outer circumference of the metal shaft and containing a conductive agent, the first transfer roller being in contact with an external surface of the belt member and forming a transfer portion in which a toner image formed on the belt member is transferred to a recording material, a second transfer roller including a metal shaft and an elastic layer formed on an outer circumference of the metal shaft, the second transfer roller provided at a position opposed to the first transfer roller with the belt member intervened and forming the transfer portion, and a power feed roller configured to abut against an outer circumferential surface of the first transfer roller to supply a current to the metal shaft of the first transfer roller, the power feed roller including a large diameter portion provided at a position corresponding to an image forming area and small diameter portions arranged at both end portions of the power feed roller and having a smaller diameter than the large diameter portion by which the power feed roller is axially supported. A width of the large diameter portion of the power feed roller with respect to a width direction intersecting a direction of movement of the belt member is equal to or greater than a maximum width of image formation and smaller than a width of a maximum size of the recording material.

According to a third aspect of the present invention, an image forming apparatus includes a belt member provided movably and configured to bear a toner image, a toner image forming unit configured to form the toner image on the belt member, a first transfer roller including a metal shaft and an elastic layer formed in a circumference of the metal shaft and containing a conductive agent, the first transfer roller being in contact with an external surface of the belt member and forming a transfer portion in which the toner image formed on the belt member is transferred to a recording material, a second transfer roller including a metal shaft and an elastic layer formed in a circumference of the metal shaft, the second transfer roller provided at a position opposed to the first transfer roller with the belt member intervened and forming the transfer portion, a power feed roller configured to abut against an outer circumferential surface of the first transfer roller at a position different from the transfer portion, and to supply a current to the metal shaft of the first transfer roller, and a power supply configured to form a potential gradient such that a potential of the metal shaft of the second transfer roller has opposite polarity as a charging polarity of toner, and to form a potential gradient such that a potential of the power feed roller has opposite polarity as the charging polarity of toner, in a state where the potential of the metal shaft of the first transfer roller is set as reference. A width of the power feed roller with respect to a width direction intersecting a direction of movement of the belt member is equal to or greater than a maximum width of image formation, and smaller than any one of a width of the elastic layer of the first transfer roller, a width of the elastic layer of the second transfer roller, or a width of the belt member.

Further features of the present invention will become apparent from the following description of exemplary embodiments with reference to the attached drawings.

DESCRIPTION OF THE EMBODIMENTS

First Embodiment

Figure 1:
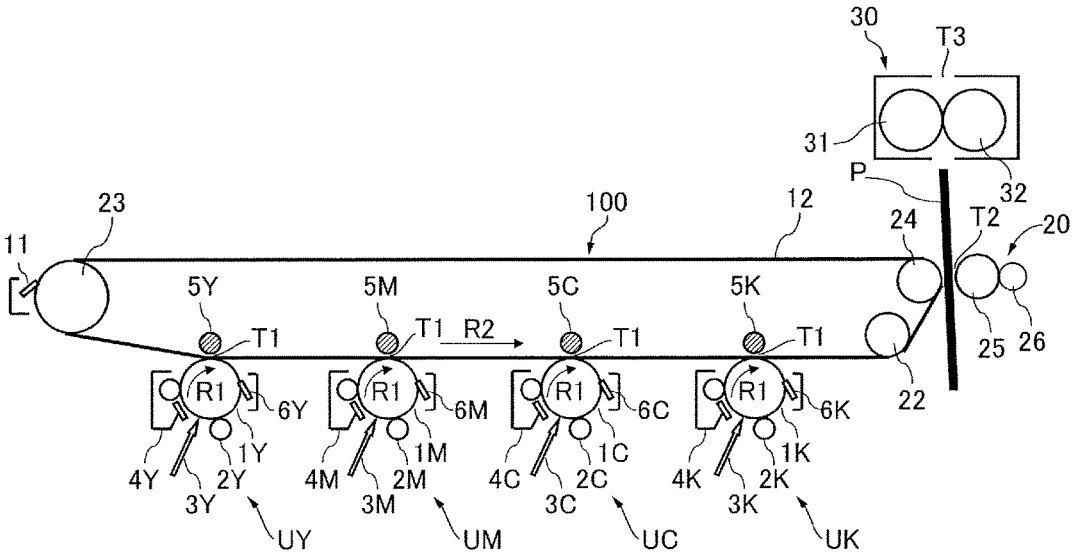
FIG. 1 is a schematic view illustrating a configuration of an image forming apparatus according to the present embodiment.

Now, preferred embodiments of the present invention will be described with reference to the drawings. First, an image forming apparatus according to the present embodiment will be described with reference to FIG. 1. FIG. 1 is a schematic view illustrating a configuration of the image forming apparatus. An image forming apparatus 100 according to FIG. 1 is a tandem intermediate transfer-type full-color printer having yellow, magenta, cyan and black image forming units UY, UM, UC and UK arranged along an intermediate transfer belt 12.

Image Forming Apparatus

In the image forming unit UY, a yellow toner image is formed on a photosensitive drum 1Y, and the image is transferred to the intermediate transfer belt 12 serving as an image bearing member. In the image forming unit UM, a magenta toner image is formed on a photosensitive drum 1M, and the image is transferred to the intermediate transfer belt 12. In the image forming units UC and UK, a cyan toner image and a black toner image are respectively formed on photosensitive drums 1C and 1K, and the images are transferred to the intermediate transfer belt 12. The toner images of four colors transferred to the intermediate transfer belt 12 are conveyed to a secondary transfer unit 20, or in further detail, a secondary transfer nip portion T2, and the toner images are collectively subjected to secondary transfer to a recording material P, such as a paper, an OHP sheet or other sheet material.

The image forming units UY, UM, UC and UK are configured approximately identically, except for differences in the toner colors used in developing apparatuses 4Y, 4M, 4C and 4K, which are yellow, magenta, cyan and black. In the following description, the configuration and operation of the image forming unit U will be described, with reference numbers assigned to components with the letters Y, M, C and K on the end of the reference numbers for distinguishing the image forming units UY, UM, UC and UK omitted.

The image forming unit U has a charging roller 2, an exposing unit 3, a developing apparatus 4, a primary transfer roller 5 and a drum cleaning apparatus 6 arranged around a photosensitive drum 1. The photosensitive drum 1 has a photosensitive layer formed on a circumferential surface of an aluminum cylinder, and the drum 1 rotates at a predetermined processing speed in a direction of arrow R1 in the drawing. A length in a width direction, i.e., rotational axis direction, of the photosensitive drum 1 is 357 mm, for example.

The charging roller 2 having a charging voltage applied thereto contacts the photosensitive drum 1, by which the photosensitive drum 1 is charged to a uniform dark potential of negative polarity. The exposing unit 3 emits laser beams corresponding to on/off modulation of image data of scanning lines obtained by developing separated color images of respective colors from a laser emitting device, and the laser beams are scanned by a rotation mirror to form an electrostatic image on the surface of the charged photosensitive drum 1. The developing apparatus 4 supplies toner to the photosensitive drum 1, and develops the electrostatic image as a toner image. In the photosensitive drum 1, a maximum width in the width direction of the drum capable of having the toner image developed, that is determined in advance in correspondence with a maximum size of recording material on which image can be formed, is referred to as a maximum width of image formation.

The primary transfer roller 5 serving as a toner image forming unit is arranged to oppose to the photosensitive drum 1 with the intermediate transfer belt 12 intervened, forming a primary transfer nip portion T1 of toner image between the photosensitive drum 1 and the intermediate transfer belt 12. In the primary transfer nip portion T1, a primary transfer voltage is applied to the primary transfer roller 5 from a high voltage power supply (not shown), for example, and the toner image is primarily transferred from the photosensitive drum 1 to the intermediate transfer belt 12. That is, in a case where a primary transfer voltage having an opposite polarity as a charging polarity of toner is applied to the primary transfer roller 5, the toner image on the photosensitive drum 1 is electrostatically attracted onto the intermediate transfer belt 12, and transfer is carried out.

The drum cleaning apparatus 6 slides a cleaning blade on the photosensitive drum 1, and recovers the small amount of toner remaining on the photosensitive drum 1 after primary transfer.

The intermediate transfer belt 12 is wound around and supported by a drive roller 22, a tension roller 23, a secondary transfer inner roller 24 and so on, and driven by the drive roller 22 to rotate, or move, in an arrow R2 direction in the drawing. Further, for example, a force pushing the intermediate transfer belt 12 from a rear side toward the front side is applied to the tension roller 23 by an elastic member such as a spring (not shown), and the intermediate transfer belt 12 is stretched with a tension of approximately 3 to 12 kgf. In the present embodiment, in a case where the drive roller 22 is driven to rotate by a motor or the like (not shown), the intermediate transfer belt 12 is rotated in a state abutted against the photosensitive drum 1. The intermediate transfer belt 12 is driven to rotate at a constant peripheral speed of 200 mm/s, for example, by the drive roller 22.

The secondary transfer nip portion T2 serving as the transfer portion is a transfer nip portion for transferring the toner image to a recording material P, formed by abutting a secondary transfer outer roller 25 against the intermediate transfer belt 12 being stretched from the inner circumferential surface on the secondary transfer inner roller 24 serving as a counter roller. In the secondary transfer nip portion T2, along with the application of secondary transfer voltage from the secondary transfer unit 20, the toner image is secondarily transferred from the intermediate transfer belt 12 to the recording material P nipped and conveyed by the secondary transfer nip portion T2. Residual toner of secondary transfer remaining on the intermediate transfer belt 12 after secondary transfer is removed by a belt cleaning apparatus 11 moved in sliding motion on the intermediate transfer belt 12.

The recording material P on which toner images of four colors have been secondarily transferred from the secondary transfer unit 20 is conveyed to a fixing unit 30. The fixing unit 30 has fixing rollers 31 and 32 abutted against one another and forming a fixing nip portion T3, and the fixing nip portion T3 conveys the recording material P and fixes the toner image onto the recording material P. In the fixing unit 30, the fixing roller 32 is in a pressure contact state by a biasing mechanism (not shown) onto the fixing roller 31 heated from an inner side by a lamp heater and the like (not shown), forming the fixing nip portion T3. The recording material P is heated/pressed by being nipped and conveyed by the fixing nip portion T3, and the toner image fixed onto the recording material P. The recording material P onto which the toner image has been fixed by the fixing unit 30 is discharged to an exterior of the apparatus.

Primary Transfer Roller

The primary transfer roller 5 described above is a metal roller in which a metal material such as SUM or SUS is used to form a roller having a shaft portion. The roller 5 can also be a roller having an elastic layer including a conductive agent formed on an outer portion, similar to the secondary transfer outer roller 25 described later. The primary transfer roller 5 is formed in a straight shape in the rotational axis direction, and the diameter thereof, i.e., roller diameter, is approximately 6 to 10 mm.

Intermediate Transfer Belt

The intermediate transfer belt 12 described above has a body portion, i.e., belt portion, formed in the shape of an endless belt using a material such as polyimide, polyamide or other resin material, an alloy thereof, or various rubber materials, and containing an appropriate amount of antistatic agent such as carbon black. The body portion of the intermediate transfer belt 12 is formed such that a surface resistivity of the belt has a conductivity of $1.0\times10^{9}$ to $5.0\times10^{13}$ (Ω/□), and such that a thickness of the belt is approximately 0.04 to 0.5 mm, for example.

Secondary Transfer Unit

Figure 2:
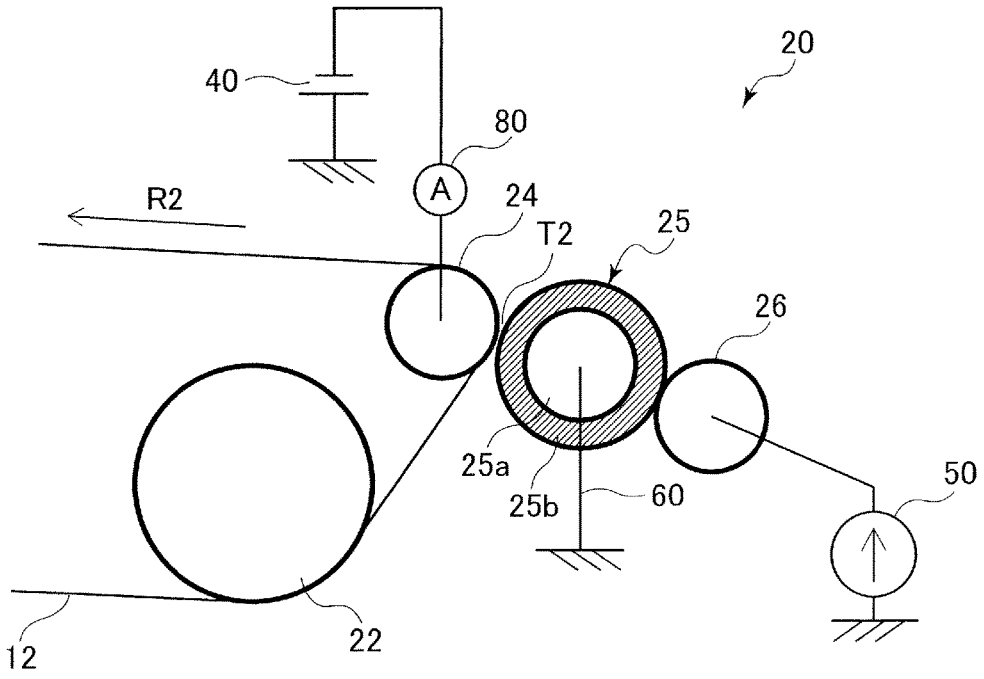
FIG. 2 is a schematic view illustrating a configuration of a secondary transfer unit according to a first embodiment.

The secondary transfer unit 20 according to a first embodiment will be described with reference to FIGS. 2 through 5B. As illustrated in FIG. 2, the secondary transfer unit 20 includes the secondary transfer inner roller 24 and the secondary transfer outer roller 25 arranged in a mutually opposed manner with the intermediate transfer belt 12 interposed therebetween, and a power feed roller 26. The secondary transfer inner roller 24, the secondary transfer outer roller 25 and the power feed roller 26 are arranged approximately in parallel with respective rotation shafts aligned in a direction of the rotational axis of the intermediate transfer belt 12, i.e., in a width direction intersecting a direction of movement. The secondary transfer inner roller 24 follows movement of and is rotated by the intermediate transfer belt 12 that is driven to rotate by the drive roller 22. The secondary transfer outer roller 25 is driven to rotate at a peripheral speed of 200 mm/s, for example, by a motor or the like (not shown). In the secondary transfer unit 20, the intermediate transfer belt 12 is nipped by the secondary transfer inner roller 24 and the secondary transfer outer roller 25, and the secondary transfer nip portion T2 is formed. The power feed roller 26 is arranged rotatably and abutted across the width direction against an outer circumference of the secondary transfer outer roller 25, and the roller 26 follows the rotation of the secondary transfer outer roller 25 and rotates.

Secondary Transfer Inner Roller

The secondary transfer inner roller 24 has a cylindrical shaft portion 24*a* formed of aluminum, and a body portion 24*b* of an elastic layer formed of EPDM rubber and the like arranged on a circumferential surface of the shaft portion 24*a*. The elastic layer contains an electron conductive agent such as a carbon filler providing conductivity to the elastic layer, and the hardness of the elastic layer is set approximately 70° (Asker C), for example. The Asker C hardness of the elastic layer of the secondary transfer inner roller 24 is preferably set from 50° to 90°. In other words, the secondary transfer inner roller 24 has a metal shaft 24*a*, and an elastic layer 24*b* formed on a circumference of the metal shaft 24*a* and serves as a second transfer roller. The secondary transfer inner roller 24 is provided at a position opposed to the first transfer roller 25 with the belt member 12 intervened, and forming the transfer portion.

Secondary Transfer Outer Roller

The secondary transfer outer roller 25, i.e., secondary transfer roller, serving as a transfer roller, has an elastic layer including a conductive agent on the outer portion. Specifically, for example, a body portion of a sponge-like elastic layer 25*b* formed, for example, of NBR rubber or EPDM rubber is arranged on a circumferential surface of a cylindrical shaft portion, i.e., conductive part, 25*a* formed of stainless steel and having conductivity, for example. The elastic layer 25*b* contains a conductive agent such as a metal complex or an ion conductive agent, which gives conductivity to the layer, and the hardness of the elastic layer is set lower than that of the elastic layer of the secondary transfer inner roller 24. The Asker C hardness of the elastic layer of the secondary transfer outer roller 25 is preferably set from 20° to 45°. The diameters, i.e., roller diameters, of the secondary transfer inner roller 24 and the secondary transfer outer roller 25 are respectively set to 20 mm and 24 mm. In other words, the above-described secondary transfer outer roller 25 has an inside portion, i.e., portion forming the roller section of the shaft portion 25*a* excluding a bearing, having conductivity, and an outside portion, i.e., elastic layer 25*b*, including a conductive agent formed on an outer portion of the inside portion, serving as a transfer roller forming a transfer portion in which the toner image formed on the intermediate transfer belt 12 serving as an image bearing member is transferred to a recording material. That is to say, the above-described secondary transfer outer roller 25 has a metal shaft 25*a*, and the elastic layer 25*b* including a conductive agent formed on a circumference of the metal shaft 25*a*, and serves as a transfer roller forming a transfer portion in contact with an external surface of the intermediate transfer belt 12 serving as an image bearing member in which the toner image formed on the image bearing member is transferred to the recording material.

Power Feed Roller

The power feed roller 26 serving as a power feed rotary member is a metal roller formed in the shape of a roller with a shaft portion using a metal material such as SUM or SUS. The power feed roller 26 has a body portion excluding the shaft portion formed in a straight shape in a width direction, i.e., rotational axis direction, and with a diameter, i.e., roller diameter, of approximately 10 mm, for example. In other words, the power feed roller 26 has a large diameter portion 26*b* provided at a position corresponding to an image forming area, and small diameter portions 26*a* arranged at both end portions of the power feed roller 26 and having a smaller diameter than the large diameter portion 26*b* by which the power feed roller 26 is axially supported.

Secondary Transfer Power Supply and External Power Supply

As shown in FIG. 2, the secondary transfer unit 20 has a secondary transfer power supply 40 and an external power supply 50. In the present embodiment, a constant voltage source having an applied voltage of −6000 V or smaller is used for example as the secondary transfer power supply 40 connected to the secondary transfer inner roller 24, and a constant current source having an applied voltage of +6500 V or smaller is used as the external power supply 50 connected to the power feed roller 26. Further, the secondary transfer unit 20 has a conduction path 60 electrically connected between the shaft portion 25*a* of the secondary transfer outer roller 25 and a ground potential, and serving as a current path supplying current from the secondary transfer outer roller 25, more specifically, the shaft portion 25*a*, to a ground potential. The conduction path 60 is a conductive member having conductivity.

The secondary transfer power supply 40 serving as the first power supply is a power supply that applies transfer bias transferring the toner image from the image bearing member to the recording material, and configured to supply a transfer current for forming the transfer bias between the inner surface and the outer surface of the elastic layer 25*b*. In further detail, the secondary transfer power supply 40 is connected to the secondary transfer inner roller 24 and configured to apply a voltage having the same polarity as the charging polarity of toner, which is negative according to the present embodiment, to the secondary transfer inner roller 24. In other words, the secondary transfer power supply 40 forms a potential gradient between an axial center of the secondary transfer inner roller 24 and an axial center 25*a* of the secondary transfer outer roller 25, such that a side corresponding to the secondary transfer outer roller 25 has positive polarity. In a state where a secondary transfer voltage is applied, a secondary transfer current forming a secondary transfer electric field directed to electrostatically attract the toner image on the intermediate transfer belt 12 to the recording material P (refer to FIG. 1) is supplied to the secondary transfer nip portion T2. As a secondary transfer current, a current maintained to 50 μA, for example, is supplied. In response thereto, the toner image is transferred from the intermediate transfer belt 12 to the recording material P. In this state, on the secondary transfer nip portion T2 side of the secondary transfer outer roller 25, positive ions within the elastic layer 25*b* tend to be biased to an outer circumferential side and negative ions to an inner circumferential side, i.e., the shaft portion 25*a* side, in the radial direction of the secondary transfer outer roller 25, and polarization tends to occur.

Therefore, according to the present embodiment, the power feed roller 26 is abutted against and arranged to oppose to the secondary transfer outer roller 25, and current is supplied from the external power supply 50 serving as the second power supply via the power feed roller 26 to the secondary transfer outer roller 25 (external power feed). In response to the application of voltage having an opposite polarity as the secondary transfer power supply 40 from the external power supply 50, the power feed roller 26 supplies a constant current of the same amount as the secondary transfer current supplied from the secondary transfer power supply 40. Specifically, a current cancelling a state where positive ions are biased to the outer circumferential side and negative ions are biased to the inner circumferential side, i.e., the shaft portion 25*a* side, in the radial direction of the secondary transfer outer roller 25 is supplied from the power feed roller 26 to the secondary transfer outer roller 25. That is, the external power supply 50 applies a voltage having an opposite polarity, which is positive according to the present embodiment, as the charging polarity of the toner image to the power feed roller 26. In other words, the external power supply 50 forms a potential gradient between the axial center 25*a* of the secondary transfer outer roller 25 and the power feed roller 26, such that the side corresponding to the secondary transfer outer roller 25 has negative polarity. The secondary transfer power supply 40 and the external power supply 50 serve as a power supply configured to form a potential gradient such that a potential of the metal shaft 24*a* of the second transfer roller 24 has opposite polarity as a charging polarity of toner, and to form a potential gradient such that a potential of the power feed roller 26 has opposite polarity as the charging polarity of toner, in a state where the potential of the metal shaft 25*a* of the first transfer roller 25 is set as reference.

In that state, an electric field directed to move the positive ions within the elastic layer 25*b* to the inner circumferential side and the negative ions to the outer circumferential side is applied between the power feed roller 26 and the secondary transfer outer roller 25. Therefore, the positive ions biased to the outer circumferential side at the secondary transfer nip portion T2 side of the secondary transfer outer roller 25 are moved to the inner circumferential side, and the negative ions biased to the inner circumferential side are moved to the outer circumferential side. Thus, the ions within the ion conductive agent in the elastic layer 25*b* of the secondary transfer outer roller 25 are moved alternately to the outer circumferential side and the inner circumferential side, i.e. the shaft portion 25*a* side, at every half-rotation of the secondary transfer outer roller 25, so that the ions will not be biased to one side. Therefore, the present embodiment enables to achieve an effect of reducing the possibility of occurrence of polarization of the ion conductive agent, and suppressing electric resistance caused by polarization. That is, the power feed roller 26 abuts against the outer circumferential surface of the secondary transfer outer roller 25 serving as the transfer roller, supplies a current to the secondary transfer outer roller 25, and also supplies a current between the inner surface and the outer surface of the elastic layer 25*b* during transfer. In a state where the direction from the inner surface toward the outer surface of the elastic layer 25*b* is referred to as positive, the direction of the current supplied from the power feed roller 26 is mutually opposite from the direction of the transfer current, with respect to the radial direction of the secondary transfer outer roller 25.

As described, in a case of an external power feed in which a current is supplied to the power feed roller 26 abutted against the secondary transfer outer roller 25, the increase of electric resistance caused by polarization can be suppressed. However, in the case of the external power feed, the power feed roller 26 is arranged approximately in parallel with the secondary transfer outer roller 25 and abutted thereto, so that the size of the secondary transfer unit 20 tends to be increased compared to the case where the external power feed is not adopted. Therefore, according to the present embodiment, a width direction length, i.e., longitudinal width, of the power feed roller 26 is adjusted to prevent increase in size of the secondary transfer unit 20. This arrangement will be described with reference to FIGS. 3 through 5B. The term longitudinal width refers to the width direction, i.e., longitudinal direction, length of a body portion including the roller portions and the belt portion excluding the shaft portion.

Figure 3:
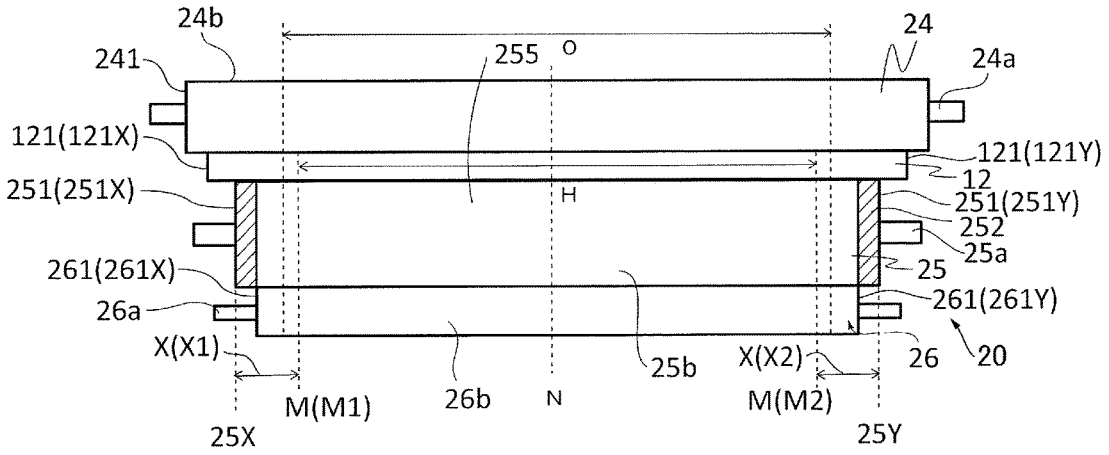
FIG. 3 is a schematic diagram illustrating a power feed roller.

In the present embodiment, the power feed roller 26 is formed so that the longitudinal length thereof is equal to or longer than a maximum width of image formation of the intermediate transfer belt 12 and shorter than the secondary transfer outer roller 25. As illustrated in FIG. 3, the secondary transfer inner roller 24, the secondary transfer outer roller 25 and the power feed roller 26 are arranged approximately in parallel with the rotational axes of the rollers 24, 25 and 26 arranged in the same direction. The rollers 24, 25 and 26 and the intermediate transfer belt 12 are arranged so that their respective center positions N in the width directions correspond. For example, the longitudinal width of the secondary transfer inner roller 24 is set to 352 mm, the secondary transfer outer roller 25 is set to 330 mm, and the power feed roller 26 is set to 326 mm. In contrast, the longitudinal width of the intermediate transfer belt 12 is set for example to 344 mm.

The intermediate transfer belt 12 has an area, i.e., area between two straight lines M of FIG. 3, corresponding to a maximum width of image formation H of the photosensitive drum 1, and the belt 12 can bear the toner image transferred from the photosensitive drum 1 in that area. The maximum width of image formation H is smaller than the respective longitudinal widths of the secondary transfer inner roller 24, the secondary transfer outer roller 25 and the power feed roller 26, and a width of 305 mm is ensured, for example, with the center position N of the intermediate transfer belt 12 set as reference. As described, the power feed roller 26 is formed to have a longitudinal width (326 mm) equal to or greater than the maximum width of image formation H (305 mm) and smaller than the longitudinal width of the secondary transfer outer roller 25 (330 mm). That is to say, the power feed roller 26 is configured so that the length of the roller in the axial direction of the abutted area abutted against the secondary transfer outer roller 25 is configured to be shorter than the length in the axial direction of the secondary transfer outer roller 25.

According to the present embodiment, the secondary transfer outer roller 25 is arranged such that both end portions 251 in the width direction are positioned between an end portion of the area corresponding to the maximum width of image formation H, i.e., position of straight line M of FIG. 3, and an end portion 121 of the intermediate transfer belt 12. That is to say, the secondary transfer outer roller 25 is positioned such that a first end portion 251X at one side in the width direction is positioned between an end portion M1 at one side in the width direction of the area corresponding to the maximum width of image formation H and an end portion 121X at one side in the width direction of the intermediate transfer belt 12, and a second end portion 251Y at the other side in the width direction is positioned between an end portion M2 on the other side in the width direction of the area corresponding to the maximum width of image formation H and the end portion 121Y on the other side in the width direction of the intermediate transfer belt 12. In contrast, the power feed roller 26 having the longitudinal width described above is arranged so that both end portions in the width direction are positioned between an end portion in the area corresponding to the maximum width of image formation H, i.e., position of straight line M of FIG. 3, and an end portion 251 of the secondary transfer outer roller 25, i.e., area X of FIG. 3. In other words, a first end portion 261X of the power feed roller 26 at one side in the width direction is positioned between the end portion M1 at one side in the width direction of the area corresponding to the maximum width of image formation H and an end portion 25X at one side in the width direction of the secondary transfer outer roller 25, i.e., area X1 of FIG. 3, and a second end portion 261Y of the power feed roller 26 at the other side in the width direction is positioned between the end portion M2 at the other side in the width direction of the area corresponding to the maximum width of image formation H and an end portion 25Y at the other side in the width direction of the secondary transfer outer roller 25, i.e., area X2 of FIG. 3. For example, in a state where the longitudinal length of the secondary transfer outer roller 25 is 330 mm and the longitudinal width of the power feed roller 26 is 326 mm, both end portions 261 of the power feed roller 26 are positioned closer to the center position N by 2 mm, respectively, than the end portion 251 of the secondary transfer outer roller 25.

In the case of the present embodiment, the longitudinal width of the power feed roller 26 is smaller than the longitudinal width of the secondary transfer outer roller 25, so that a non-abutted area 252 is created in the secondary transfer outer roller 25 where the roller 25 is not abutted against the power feed roller 26 (refer to the area illustrated by oblique lines in FIG. 3). In a state where the non-abutted area 252 is created in the secondary transfer outer roller 25, if the effect of suppressing the increase of electric resistance caused by polarization is reduced, it is preferable for the longitudinal width of the power feed roller 26 not to be smaller than the longitudinal width of the secondary transfer outer roller 25. That is, the longitudinal width of the power feed roller 26 relates to the abutted area with the secondary transfer outer roller 25, and depending on the longitudinal width of the power feed roller 26 with respect to the secondary transfer outer roller 25, it may affect the suppressing of increase of the electric resistance caused by the above-described polarization.

Figure 4A:
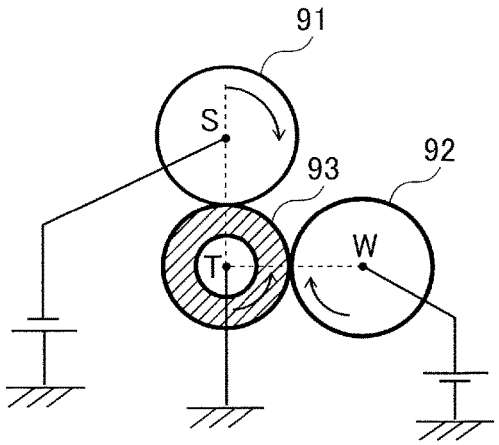
FIG. 4A is a side view of an experimental apparatus.
Figure 4B:
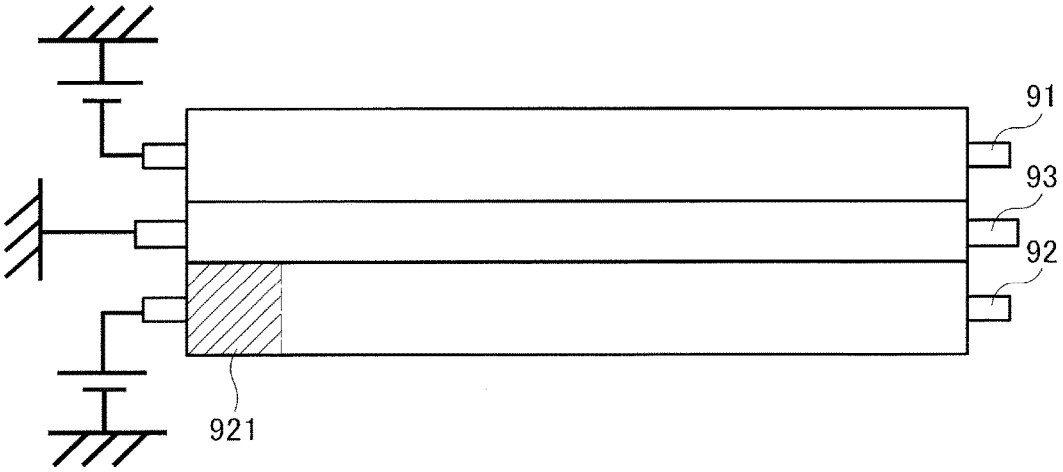
FIG. 4B is a front view of an experimental apparatus.

Therefore, the present inventors have performed a test illustrated below, in order to verify the suppression of increase of electric resistance in a state where the non-abutted area 252 is created in the secondary transfer outer roller 25. The test will be described with reference to FIGS. 4A through 5B. FIGS. 4A and 4B illustrate an experimental apparatus.

As illustrated in FIG. 4A, in the experimental apparatus, a metal roller 91 (corresponding to the secondary transfer inner roller) and a metal roller 92 (corresponding to the power feed roller) respectively having a diameter of 30 mm were rotatably abutted against a sponge roller 93 (corresponding to the secondary transfer outer roller) having a diameter of 24 mm. The sponge roller 93 had a 4 mm-thick elastic layer disposed on a circumferential surface of a shaft portion having conductivity and having a diameter of 16 mm, with an ion conductive agent dispersed in the elastic layer by which conductivity is given to the elastic layer. The respective rotation shafts of the metal rollers 91 and 92 and the sponge roller 93 were arranged in the same direction and approximately in parallel. However, the metal roller 91 and the metal roller 92 were arranged such that an angle formed by a straight line connecting a center of rotation T of the sponge roller 93 and a center of rotation S of the metal roller 91 with a straight line connecting the center of rotation T of the sponge roller 93 and a center of rotation W of the metal roller 92 was set to 90 degrees. A negative voltage of 2 kV was applied from a power supply to the metal roller 91, and a positive voltage of 2 kV was applied from a power supply to the metal roller 92. A shaft portion of the sponge roller 93 was connected to ground potential.

Further, as illustrated in FIG. 4B, the longitudinal widths of the metal rollers 91 and 92 and the sponge roller 93 were set to the same length, which is 330 mm. Then, an insulated area 921 was formed by adhering an insulation tape with a width of 50 mm on a whole periphery of an end portion closer to a power supply of the metal roller 92 (left side in the drawing), such that current would not flow between the sponge roller 93 and the metal roller 92 in the insulated area 921. In that state, voltage was applied to the metal rollers 91 and 92 for approximately 50 hours while rotating the respective rollers 91, 92 and 93 at a rotational speed of 30 mm/s. Thereby, in the sponge roller 93 excluding the insulated area 921, ions within the ion conductive agent in the elastic layer were enabled to move alternately to the outer circumferential side and to the inner circumferential side at every half-rotation of the sponge roller 93.

Figure 5A:
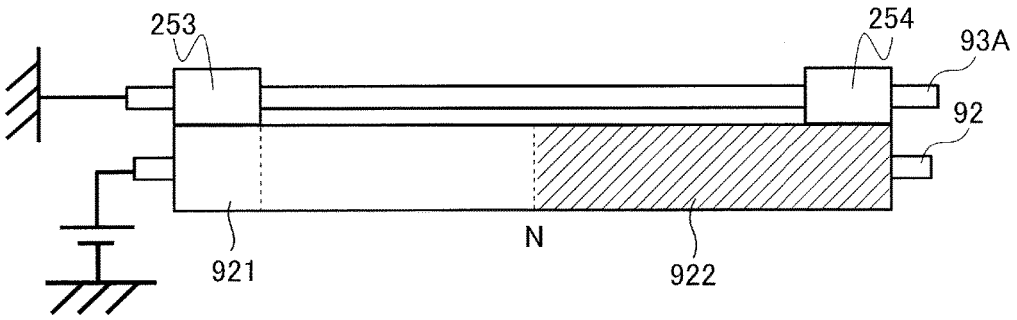
FIG. 5A is a schematic diagram illustrating an electric resistance caused by polarization in a state where a side positioned away from a power supply is insulated.

After completing the approximately 50 hours of power feed, the metal roller 91 was removed, as illustrated in FIG. 5A, and a two-point-contact type sponge roller 93A with a contact portion 253 and a contact portion 254 formed of elastic layers having conductivity was attached in place of the sponge roller 93. Respective longitudinal widths of the contact portion 253 and the contact portion 254 were set to the same width as the insulated area 921 of the metal roller 92, that is, to 50 mm. Then, an insulated area 922 was formed by adhering an insulated tape with a width covering a range from an end portion of the side not in contact with the power supply (right side in the drawing) to a center position N of the metal roller 92 on a whole periphery. That is, in the insulated area 922, current was prevented from flowing between the sponge roller 93A, more specifically, the contact portion 254, and the metal roller 92. In this state, positive voltage of 2 kV was applied to the metal roller 92, and the current flown between the metal roller 92 and the sponge roller 93A was measured. Based on the voltage-current characteristics obtained in this state, the obtained electric resistance value of the sponge roller 93A was $7.6\times10^{8}\Omega$.

Figure 5B:
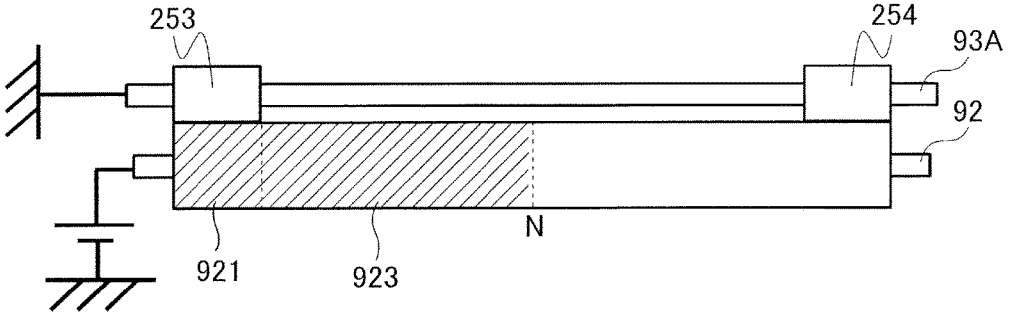
FIG. 5B is a schematic diagram illustrating the electric resistance caused by polarization in a state where a side positioned close to the power supply is insulated.

Next, the insulation tape having formed the insulated area 922 was removed from the metal roller 92, and an insulation tape with a width covering a range from an end portion of the side connected to the power supply (left side in the drawing) to the center position N was adhered on the whole periphery to form an insulated area 923, as illustrated in FIG. 5B. In other words, in the insulated area 923, current was prevented from flowing between the sponge roller 93A, more specifically, the contact portion 253, and the metal roller 92. In this state, positive voltage of 2 kV was applied to the metal roller 92, and the current flown between the metal roller 92 and the sponge roller 93A was measured. Based on the voltage-current characteristics obtained in this state, the electric resistance value of the sponge roller 93A was $2.9\times10^{8}\Omega$.

Before starting power feed lasting for approximately 50 hours, the electric resistance value of the sponge roller 93 illustrated in FIG. 4B was measured, and the result was $4.0\times10^{7}\Omega$. If that is so, the electric resistance value of the contact portion 253 and the contact portion 254 formed to have a width of 50 mm should be approximately $2.6\times10^{8}\Omega$. However, in a case where current is prevented from flowing between the sponge roller 93A and the metal roller 92 in the insulated area 922, as illustrated in FIG. 5A, the electric resistance value was approximately 2.9 times, as mentioned above. This shows that in the case of FIG. 4B, since current is not supplied in the insulated area 921, the increase of electric resistance caused by polarization has not been suppressed within the 50-mm width area corresponding to the contact portion 253. On the other hand, if current is prevented from being supplied between the sponge roller 93A and the metal roller 92 within the insulated area 923, as illustrated in FIG. 5B, the electric resistance value was approximately 1.1 times, as described above. This shows that in the case of FIG. 4B described above, the increase of electric resistance caused by polarization was suppressed by having current supplied in the range other than the insulated area 921.

Based on the test described above, it has been confirmed that current is less likely to flow in the non-abutted area 252 of the secondary transfer outer roller 25 illustrated in FIG. 3 compared to an abutted area 255 abutted against the power feed roller 26. This is because the non-abutted area 252 is an area not abutted against the power feed roller 26, and in the non-abutted area 252, increase of electric resistance caused by polarization is likely to occur.

It is considered that electric conduction between the secondary transfer outer roller 25 and the power feed roller 26 is mainly performed in the abutted area 255 of the secondary transfer outer roller 25. In the case of the present embodiment, even if the longitudinal width of the power feed roller 26 is smaller than the longitudinal width of the secondary transfer outer roller 25, the abutted area 255 having a greater width than the maximum width of image formation H is ensured. Therefore, at least in the area of the secondary transfer outer roller 25 corresponding to the maximum width of image formation H, increase of electric resistance caused by polarization is suppressed, so that sufficient transfer current can flow to the secondary transfer nip portion T2 during image formation, and image defects will not occur easily.

As described, the image forming apparatus 100 according to the present embodiment adopts an external power feed where current is supplied from the power feed roller 26 abutted against the secondary transfer outer roller 25. In this case, the longitudinal width of the power feed roller 26 is formed equal to or greater than the maximum width of image formation of the intermediate transfer belt 12 and smaller than the secondary transfer outer roller 25. In other words, with respect to the width direction, the width of the power feed roller 26 is equal to or greater than the maximum width of image formation H and smaller than the width of the secondary transfer outer roller 25 serving as the transfer roller. According to this configuration, the secondary transfer unit 20 can be downsized. Further, the power feed roller 26 having such longitudinal width is arranged such that the both end portions in the width direction are positioned between the end portions of the area corresponding to the maximum width of image formation and the end portions of the secondary transfer outer roller 25. Thereby, even if the longitudinal width of the power feed roller 26 is smaller than the longitudinal width of the secondary transfer outer roller 25, the increase of electric resistance caused by polarization can be suppressed. As described, according to the present embodiment, in the case of external power feed, suppressing of increase of electric resistance caused by polarization and downsizing of the apparatus can be realized at the same time by a simple configuration. Incidentally, the length corresponding to shaft portions of the respective rollers are not included in the width of the transfer roller and the width of the power feed roller described above, and the widths only refer to the roller portions. That is, the width of each roller refers to the portion excluding small diameter portions axially supported at both ends of each roller, and refers to the width of a large diameter portion provided to correspond to an image forming area.

Moreover, if the longitudinal width of the power feed roller 26 is set smaller than the longitudinal width of the secondary transfer outer roller 25 as according to the present embodiment, a leak current flowing from the power feed roller 26 to the ground potential can be reduced. The leak current is a current flowing from the power feed roller 26 through the surface of end portions 261 and 251 to the ground potential, without passing the shaft potion 25*a* of the secondary transfer outer roller 25. Since the leak current flows more easier if more voltage is applied to the power feed roller 26, by reducing the leak current, the maximum value of the voltage applied to the power feed roller 26 can be increased. Thereby, a high voltage can be applied to the power feed roller 26 in response to the voltage value applied to the secondary transfer inner roller 24, so that a higher effect can be achieved regarding the suppressing of increase of electric resistance caused by polarization.

Specifically, if the longitudinal width of the power feed roller 26 is 326 mm with respect to the longitudinal width of the secondary transfer outer roller 25, which is 330 mm, in a case where the thickness of the elastic layer 25*b* of the secondary transfer outer roller 25 is 6 mm, a creepage distance of insulation between the shaft portion 25*a* of the secondary transfer outer roller 25 and the power feed roller 26 will be 8 mm. Generally, the creeping distance capable of ensuring insulation is approximately 1 mm with respect to a potential difference of 1 kV, the leak current flowing between the secondary transfer outer roller 25 and the power feed roller 26 can be prevented if a creeping distance of insulation of approximately 8 mm is ensured. The creepage distance of insulation described here is a shortest path of current flowing to the ground potential along the surfaces of mutual conductive parts of the secondary transfer outer roller 25 and the power feed roller 26 among the current supplied from the power feed roller 26.

Second Embodiment

A secondary transfer unit according to a second embodiment will be described with reference to FIG. 6. Compared to the secondary transfer unit 20 of the first embodiment (refer to FIG. 2), a secondary transfer unit 20A of the second embodiment differs in that a Zener diode 61 serving as an electrical member is intervened in the conduction path 60, and the other configurations are the same. The same configurations are denoted with the same reference numbers as the first embodiment, and the descriptions thereof are omitted.

Figure 6:
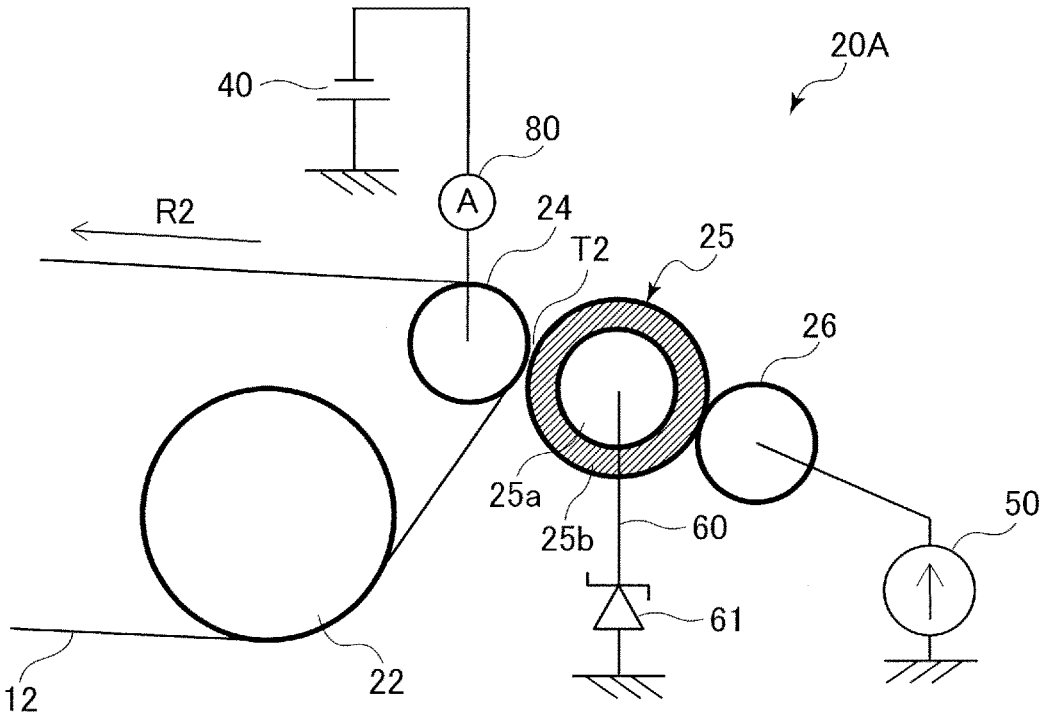
FIG. 6 is a schematic view illustrating a configuration of a secondary transfer unit according to a second embodiment.

In the configuration illustrated in FIG. 6, breakdown voltage of the Zener diode 61 is sufficiently small (50 V, for example) compared to the applied voltage of the secondary transfer power supply 40 and the external power supply 50, so that a large amount of current applied from the power feed roller 26 is flown through the Zener diode 61 to the ground potential. That is, the Zener diode 61 flows the current supplied to the shaft portion 25*a* to the ground potential in a state where the potential difference between the potential of the shaft portion 25*a* and the ground potential is equal to or greater than a predetermined value. Accordingly, it becomes possible to adjust the potential of the shaft portion 25*a* of the secondary transfer outer roller 25 using the Zener diode 61 having a different breakdown voltage, such that the current supplied from the power feed roller 26 flows to the ground potential. According to this configuration, the amount of current flowing from the secondary transfer inner roller 24 to the secondary transfer outer roller 25 and the amount of current flowing from the power feed roller 26 to the secondary transfer outer roller 25 can be adjusted to be approximately the same, and the increase of electric resistance caused by polarization can be suppressed. Even according to this case, as described above, the power feed roller 26 having a smaller longitudinal width than the secondary transfer outer roller 25 is arranged so that the both end portions in the width direction are positioned between the end portions of the area corresponding to the maximum width of image formation and the end portions of the secondary transfer outer roller 25. Thereby, an effect similar to the first embodiment described earlier can be achieved.

Third Embodiment

A secondary transfer unit according to a third embodiment will be described with reference to FIG. 7. A secondary transfer unit 20B according to the third embodiment differs from the secondary transfer unit 20 according to the first embodiment (refer to FIG. 2) in that a varistor 62 serving as an electrical member is intervened in the conduction path 60, and other configurations are the same. The same configurations are denoted with the same reference numbers as the first embodiment, and the descriptions thereof are omitted.

Figure 7:
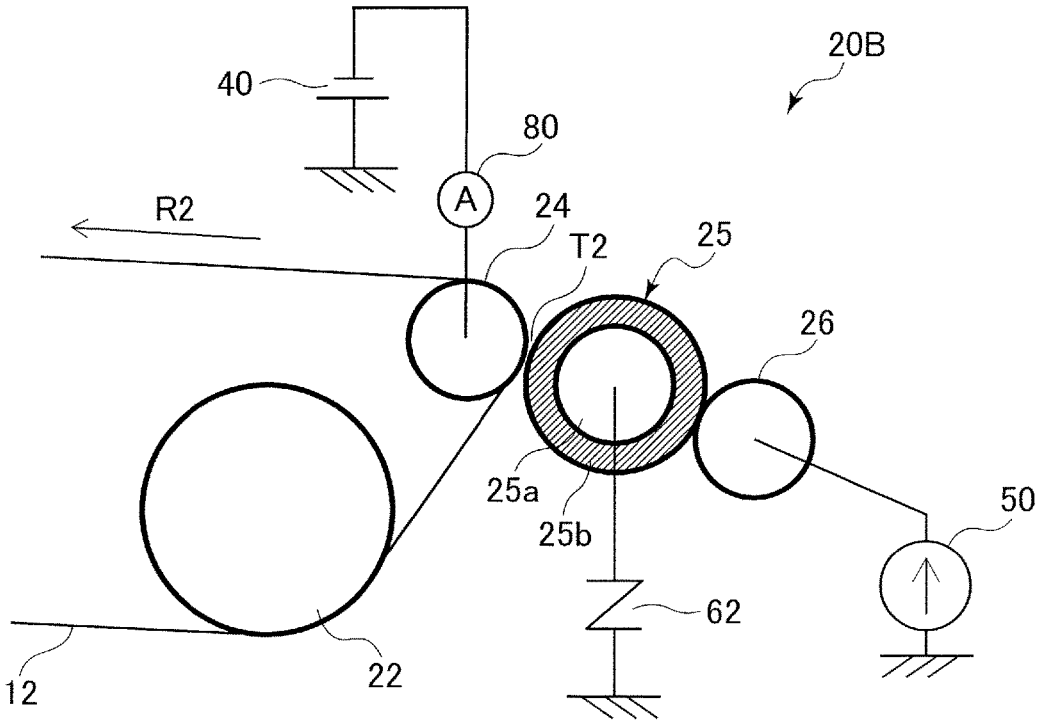
FIG. 7 is a schematic view illustrating a configuration of a secondary transfer unit according to a third embodiment.

As illustrated in FIG. 7, the case in which the varistor 62 is adopted is similar to the Zener diode 61 illustrated in the second embodiment. That is, if a varistor voltage of the varistor 62 is sufficiently small (50 V, for example) compared to the applied voltage of the secondary transfer power supply 40 and the external power supply 50, a large amount of current supplied from the power feed roller 26 flows to the ground potential. According to this configuration, the amount of current flowing from the secondary transfer inner roller 24 to the secondary transfer outer roller 25 and the amount of current flowing from the power feed roller 26 to the secondary transfer outer roller 25 can be adjusted to be approximately the same, and the increase of electric resistance caused by polarization can be suppressed. Even according to this case, as described above, the power feed roller 26 having a smaller longitudinal width than the secondary transfer outer roller 25 is arranged so that the both end portions in the width direction are positioned between the end portions of the area corresponding to the maximum width of image formation and the end portions of the secondary transfer outer roller 25. Thereby, an effect similar to the first embodiment described earlier can be achieved.

Fourth Embodiment

A secondary transfer unit according to a fourth embodiment will be described with reference to FIG. 8. Compared to the secondary transfer unit 20 of the first embodiment (refer to FIG. 2), the secondary transfer unit 20C of the fourth embodiment differs in that a low-voltage power supply 63 serving as a third power supply is arranged in the conduction path 60, and the other configurations are the same. The same configurations are denoted with the same reference numbers as the first embodiment, and the descriptions thereof are omitted.

Figure 8:
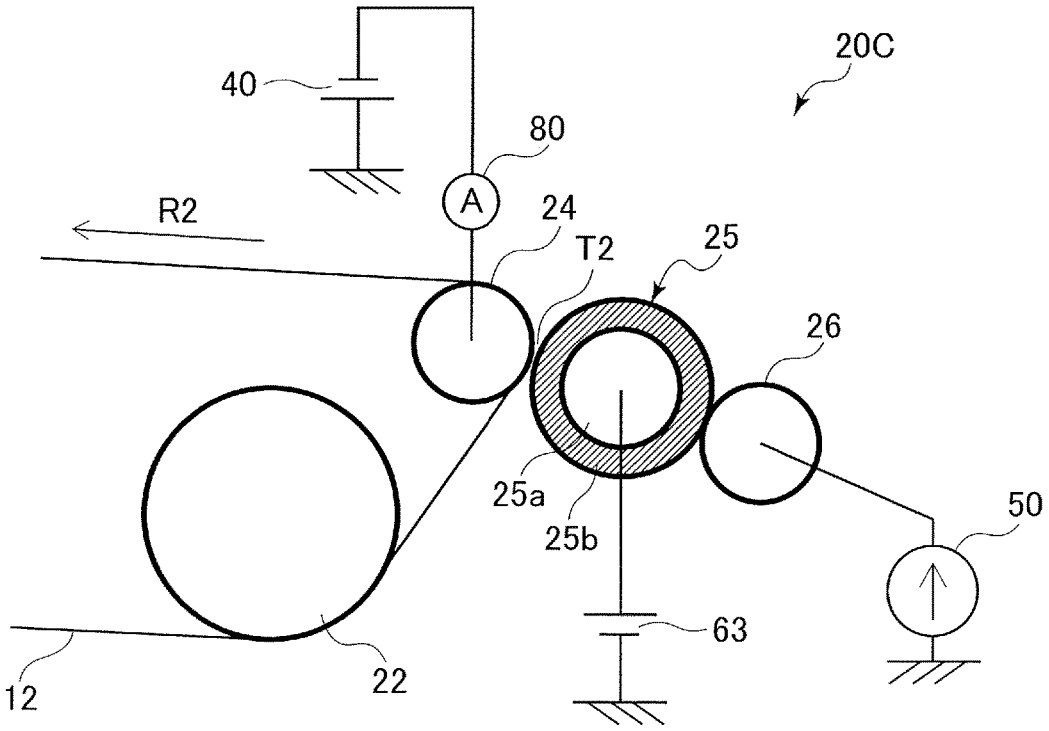
FIG. 8 is a schematic view illustrating a configuration of a secondary transfer unit according to a fourth embodiment.

As illustrated in FIG. 8, the case in which the low-voltage power supply 63 is arranged in the conduction path 60 is the same as where the Zener diode 61 is arranged as according to the second embodiment. The low-voltage power supply 63 applies a voltage having a small absolute value compared to the respective voltages applied from the secondary transfer power supply 40 and the external power supply 50. If the voltage applied by the low-voltage power supply 63 is sufficiently small (20 V, for example) compared to the applied voltage from the secondary transfer power supply 40 and the external power supply 50, a large amount of the current supplied from the power feed roller 26 flows to the ground potential. In other words, by changing the voltage applied by the low-voltage power supply 63, the potential of the shaft portion 25*a* of the secondary transfer outer roller 25 can be adjusted such that the current supplied from the power feed roller 26 is flown to the ground potential. According to this configuration, the amount of current flowing from the secondary transfer inner roller 24 to the secondary transfer outer roller 25 and the amount of current flowing from the power feed roller 26 to the secondary transfer outer roller 25 can be adjusted to be approximately the same, and the increase of electric resistance caused by polarization can be suppressed. Even according to this case, as described above, the power feed roller 26 having a smaller longitudinal width than the secondary transfer outer roller 25 is arranged so that the both end portions in the width direction are positioned between the end portions of the area corresponding to the maximum width of image formation and the end portions of the secondary transfer outer roller 25. Thereby, an effect similar to the first embodiment described earlier can be achieved.

Fifth Embodiment

A secondary transfer unit according to a fifth embodiment will be described with reference to FIG. 9. Compared to the secondary transfer unit 20 of the first embodiment (refer to FIG. 2), a secondary transfer unit 20D according to the fifth embodiment differs in that the secondary transfer outer roller 25 is not connected to the ground potential and is electrically in a floating condition. Further, it differs in that the secondary transfer inner roller 24 does not have the secondary transfer power supply 40 connected thereto, but instead, the roller 24 is connected via the conduction path 60 to the ground potential. Further, it differs in that a constant voltage source, i.e., a secondary transfer power supply 70, is used as an external power supply instead of a constant current source. The other configurations are the same. The same configurations are denoted with the same reference numbers as the first embodiment, and the descriptions thereof are omitted. In the present embodiment, the secondary transfer power supply 70 having an applied voltage up to +6000 (V) is used.

Figure 9:
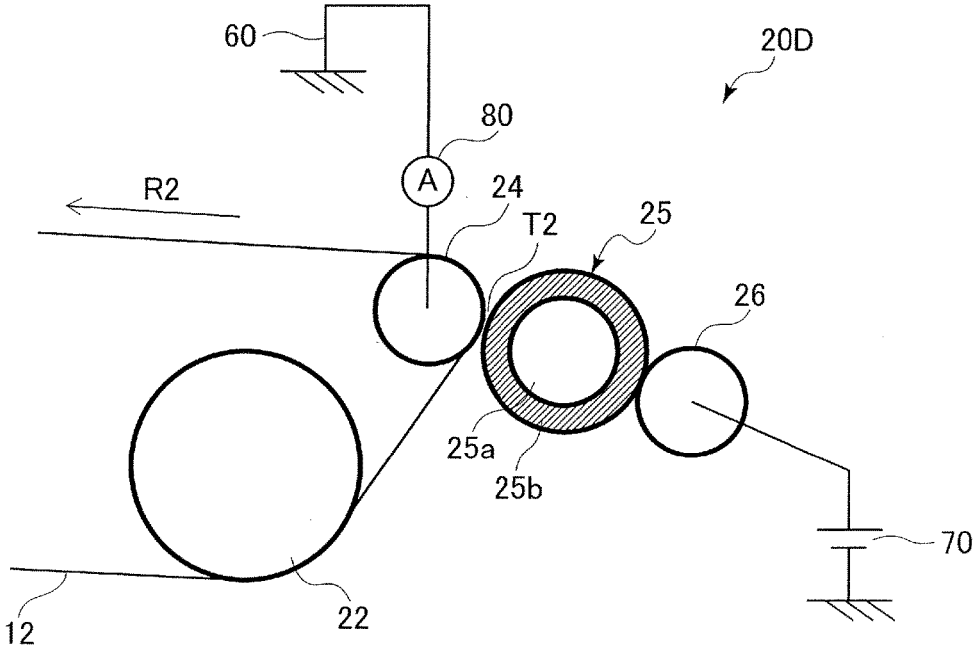
FIG. 9 is a schematic view illustrating a configuration of a secondary transfer unit according to a fifth embodiment.

In the configuration illustrated in FIG. 9, accompanying the application of voltage from the secondary transfer power supply 70, current is flown from the power feed roller 26 to the secondary transfer outer roller 25. The current supplied from the power feed roller 26 is flown to the shaft portion 25*a* of the secondary transfer outer roller 25, and also from the shaft portion 25*a* to the secondary transfer inner roller 24. In this case, by the current flown from the shaft portion 25*a* to the secondary transfer inner roller 24, an electric field having a direction electrically attracting the toner image formed on the intermediate transfer belt 12 to the recording material P (refer to FIG. 1) is formed in the secondary transfer nip portion T2. In this state, at the secondary transfer nip portion T2 side of the secondary transfer outer roller 25, the positive ions within the elastic layer 25*b* tend to be biased to the outer circumferential side and the negative ions tend to be biased to the inner circumferential side, i.e., shaft portion 25*a* side, in the radial direction of the secondary transfer outer roller 25. However, on the side where the power feed roller 26 and the secondary transfer outer roller 25 abut against one another, an electric field having a direction moving the positive ions within the elastic layer 25*b* to the inner circumferential side and the negative ions to the outer circumferential side is applied to the area between the power feed roller 26 and the secondary transfer outer roller 25, that is, in further detail, the abutted area. Therefore, even if polarization occurs at the secondary transfer nip portion T2 side, the positive ions having been biased to the outer circumferential side at the secondary transfer nip portion T2 side are moved to the inner circumferential side and the negative ions having been biased to the inner circumferential side are moved to the outer circumferential side. As described, the ions in the ion conductive agent within the elastic layer 25*b* move to the outer circumferential side and the inner circumferential side of the secondary transfer outer roller 25 alternately at every half-rotation of the secondary transfer outer roller 25, and are prevented from being biased to one side, so that the increase of electric resistance caused by polarization is suppressed. Even according to this case, as described above, the power feed roller 26 having a smaller longitudinal width than the secondary transfer outer roller 25 is arranged so that the both end portions in the width direction are positioned between the end portions of the area corresponding to the maximum width of image formation and the end portions of the secondary transfer outer roller 25. Thereby, an effect similar to the first embodiment described earlier can be achieved.

Sixth Embodiment

A secondary transfer unit according to a sixth embodiment will be described with reference to FIG. 10. Compared to the secondary transfer unit 20 of the first embodiment (refer to FIG. 3), a secondary transfer unit 20E according to the sixth embodiment differs in that the width of the secondary transfer outer roller 25 is smaller than the width of the power feed roller 26. Further according to the present embodiment, the width of the power feed roller 26 is set smaller than the secondary transfer inner roller 24 and the intermediate transfer belt 12. According to this configuration, it becomes possible to prevent the size of the apparatus body from increasing in the longitudinal direction of the power feed roller 26, while moderating rise of conducting resistance across the whole longitudinal area of the secondary transfer outer roller 25.

In the present embodiment, the width of the power feed roller 26 is set smaller than both the secondary transfer inner roller 24 and the intermediate transfer belt 12, but the increase in size of the apparatus body can be suppressed by setting the width smaller than either one of the components.

According further to the present embodiment, the width of the secondary transfer outer roller 25 is smaller than the width of the power feed roller. Therefore, the following effect is also obtained. In a state where the width of the secondary transfer outer roller 25 is greater than the width of the power feed roller 26, edges on both ends of the power feed roller 26 are pressed against an outer surface of the secondary transfer outer roller 25. If the edges on both ends of the power feed roller 26 are pressed against the outer surface of the secondary transfer outer roller 25, parts of the secondary transfer outer roller 25 on which the edges on both ends of the power feed roller 26 contact are locally worn. Then, scraped portions of the secondary transfer outer roller 25 created by abrasion intrudes into the transfer units and the like, possibly causing transfer defects. However, according to the configuration of the present embodiment, the width of the secondary transfer outer roller 25 is set smaller than the width of the power feed roller 26, such that edges on both ends of the power feed roller 26 are arranged outside the secondary transfer outer roller 25. Therefore, the local abrasion of the secondary transfer outer roller 25 described above is suppressed.

We will now describe the relationship among specific lengths of the longitudinal widths of the respective components pertaining to the secondary transfer portion. According to the present embodiment, the width of the secondary transfer belt 12 is 351 mm, the width of the secondary transfer inner roller 24 is 331 mm, the width of the secondary transfer outer roller 25 is 310 mm and the width of the power feed roller 26 is 310.6 mm, a width of a maximum size sheet is 320 mm, and a maximum width in which an image can be formed is 305 mm. According further to the present embodiment, the edges on both ends of the power feed roller 26 have tapered parts in which diameters are reduced toward respective outer sides of thrust width. The tapered parts are provided with the aim to remove flashes and the like occurring at both ends, i.e., edges, of the large diameter portion of the power feed roller 26. The thrust width of the power feed roller 26 excluding the tapered parts is 310.2 mm.

Figure 10:
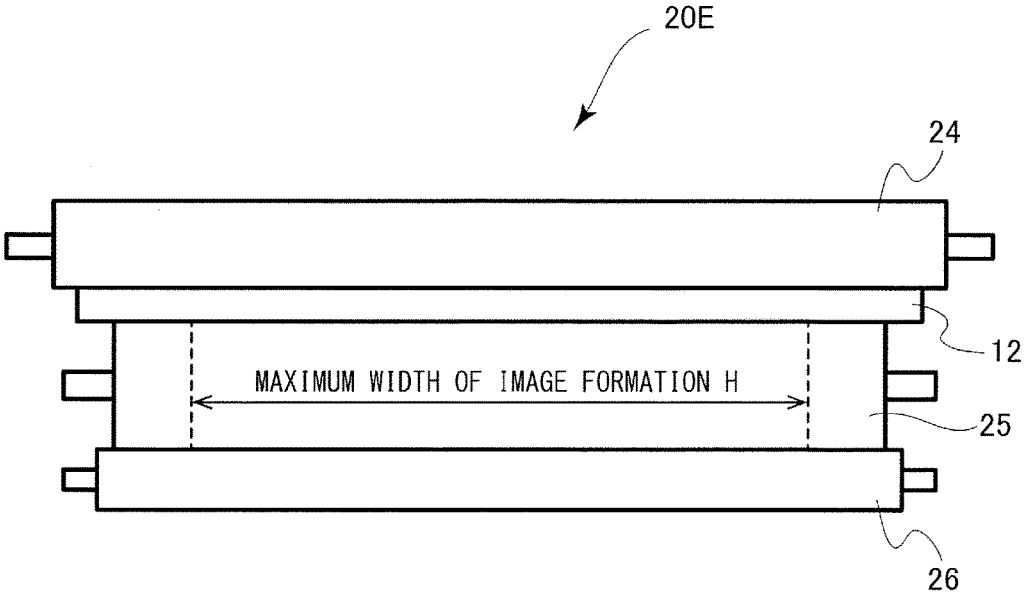
FIG. 10 is a schematic view illustrating a configuration of a secondary transfer unit according to a sixth embodiment.

The respective components pertaining to the secondary transfer portion are arranged such that the longitudinal center positions, the center positions of the maximum sheet pass width and the center positions of the maximum image formation width all correspond, and the positional relation of the components is set as illustrated in FIG. 10, with longitudinal end portions of the power feed roller 26 positioned on an outer side than the longitudinal end portions of the secondary transfer outer roller 25.

Other Embodiments

The power feed roller 26 can be arranged so that both end portions in the width direction are arranged between end portions of an area corresponding to a maximum sheet pass width O and the end portions of the secondary transfer outer roller 25. As illustrated in FIG. 3, the maximum sheet pass width O, i.e., a width of a maximum size of the recording material, is ensured to a width greater than the maximum width of image formation H, for example to a width of 320 mm, with the center position N of the intermediate transfer belt 12 set as reference. The maximum sheet pass width O is a width of an area through which passes the recording material P having a maximum size capable of having the toner image on the intermediate transfer belt 12 secondarily transferred in the secondary transfer nip portion T2. Further, according to this case, the power feed roller 26 should preferably have a longitudinal width approximately the same as the longitudinal width of a recording material having a maximum size. According to this configuration, the apparatus can be downsized as much as possible while ensuring a margin of a range in which the increase of electric resistance caused by polarization can be suppressed reliably.

According to the illustrated embodiments, the secondary transfer inner roller 24, the secondary transfer outer roller 25, the power feed roller 26 and the intermediate transfer belt 12 are arranged so that respective center positions N correspond, but the present invention is not restricted thereto, and the components do not need to have corresponding center positions N.

Further, the above-described embodiments utilize a constant voltage source as the secondary transfer power supply 40 and a constant current source as the external power supply 50, but the present invention is not restricted to such configuration. For example, a constant current source can be used as the secondary transfer power supply 40 and the constant voltage source can be used as the external power supply 50. Moreover, both the secondary transfer power supply 40 and the external power supply 50 can be constant voltage sources or constant current sources. In any combination, the above-described increase of electric resistance caused by polarization can be suppressed.

According to the respective embodiments described above, an intermediate transfer method in which the toner image formed on the photosensitive drum is transferred to the intermediate transfer belt has been described, but a direct transfer method in which the toner image formed on the photosensitive drum is transferred directly to the recording material can also be adopted. The above-mentioned invention can also be applied to an image forming apparatus other than the printer, such as a copying machine, a facsimile machine or a multifunctional apparatus. The respective embodiments can be combined with other embodiments as appropriate within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-005717, filed Jan. 15, 2016, and Japanese Patent Application No. 2016-241864, filed Dec. 14, 2016, which are hereby incorporated by reference herein in their entirety.

What is claimed is:

1. An image forming apparatus comprising:

a belt member provided movably and configured to bear a toner image;

a toner image forming unit configured to form the toner image on the belt member;

a transfer roller comprising a metal shaft and an elastic layer formed on a circumference of the metal shaft, the transfer roller being in contact with an outer surface of the belt member and configured to transfer the toner image formed on the belt member to a recording material;

a conductive roller configured to abut against an outer circumferential surface of the elastic layer of the transfer roller, the conductive roller comprising a large diameter portion provided at a position corresponding to an image forming area, and small diameter portions arranged at both end portions of the conductor roller and having a smaller diameter than that of the large diameter portion, the small diameter portions being rotatably supported; and a power supply configured to supply a transfer current to the transfer roller through an electrical path formed between the belt member and the conductive roller via the shaft of the transfer roller, wherein a width of the large diameter portion of the conductive roller with respect to a width direction intersecting a direction of movement of the belt member is equal to or greater than a width of a maximum image formation area and smaller than a width of the elastic layer of the transfer roller.

2. The image forming apparatus according to claim 1, wherein with respect to the width direction, the width of the large diameter portion of the conductive roller has a width smaller than a width of a recording material having a maximum size.

3. The image forming apparatus according to claim 1, wherein the conductive roller is arranged such that a center in the width direction of the conductive roller corresponds to a center in the width direction of the transfer roller.

4. The image forming apparatus according to claim 1, wherein with respect to the width direction, a width of the elastic layer of the transfer roller is smaller than a width of the belt member.

5. The image forming apparatus according to claim 1, wherein the belt member is an intermediate transfer belt configured to bear a toner image primarily transferred from a photosensitive drum, and the transfer roller is a secondary transfer roller configured to perform secondary transfer of the toner image from the intermediate transfer belt to the recording material.

6. The image forming apparatus according to claim 5, wherein the transfer roller is a first transfer roller, and the image forming apparatus further comprises a second transfer roller having a metal shaft and an elastic layer formed on a circumference of the metal shaft, the second transfer roller being provided at a position opposed to the first transfer roller with the belt member interposed therebetween, wherein the power supply comprises;

a first power supply configured to apply a voltage having a same polarity as the charging polarity of toner, and to supply a current to the second transfer roller, and a second power supply configured to apply a voltage having a polarity opposite that of the first power supply to the conductive roller, wherein the metal shaft of the secondary transfer roller is electrically connected to a ground potential.

7. The image forming apparatus according to claim 1, wherein the transfer roller is a first transfer roller, and the image forming apparatus further comprises:

a second transfer roll having a metal shaft and an elastic layer formed on a circumference of the metal shaft, the second transfer roller being provided at a position opposed to the first transfer roller with the belt member interposed therebetween, and a conduction path electrically connecting the second transfer roller to a ground potential, wherein the power supply is configured to apply a voltage having a polarity opposite to a charging polarity of toner to the conductive roller, and supply the transfer current via the shaft of the first transfer roller to the second transfer roller.

8. An image forming apparatus comprising:

a belt member configured to move and to bear a toner image;

a toner image forming unit configured to form a toner image on the belt member;

a transfer roller comprising a metal shaft and an elastic layer formed on an outer circumference of the metal shaft, the transfer roller being in contact with an outer surface of the belt member and configured to transfer the toner image formed on the belt member is transferred to a recording material;

a conductive roller configured to abut against an outer circumferential surface of the elastic layer of the transfer roller, the conductive roller a large diameter portion provided at a position corresponding to an image forming area, and small diameter portions arranged at both end portions of the conductive roller and having a smaller diameter than that of the large diameter portion, the small diameter portions being rotatably supported; and a power supply configured to supply a transfer current to the transfer roller through an electrical path formed between the belt member and the conductive roller via the shaft of the transfer roller, wherein a width of the large diameter portion of the conductive roller with respect to a width direction intersecting a direction of movement of the belt member is equal to or greater than a width of a maximum image formation area and smaller than a width of a maximum size of the recording material.

9. The image forming apparatus according to claim 8, wherein with respect to the width direction, both ends of the large diameter portion of the conductive roller are positioned further inward than both end portions of an area through which a recording material having a maximum size passes. than respective voltages applied from the first power supply and the second power supply.

10. The image forming apparatus according to claim 8, wherein both end portions of the elastic layer of the transfer roller contact the large diameter portion of the conductive roller.

11. The image forming apparatus according to claim 8, wherein the elastic layer of the transfer roller contains an ion conductive agent.

12. An image forming apparatus comprising:

a belt member provided movably and configured to bear a toner image;

a toner image forming unit configured to form the toner image on the belt member;

a first transfer roller comprising a metal shaft and an elastic layer formed on a circumference of the metal shaft, the first transfer roller being in contact with an outer surface of the belt member and configured to transfer the toner image formed on the belt member to a recording material;

a second transfer roller comprising a metal shaft and an elastic layer formed on a circumference of the metal shaft, the second transfer roller provided at a position opposed to the first transfer roller with the belt member interposed therebetween;

a conductive roller configured to abut against an outer circumferential surface of the first transfer roller, the conductive roller comprising a large diameter portion provided at a position corresponding to an image forming area, and small diameter portions arranged at both end portions of the conductive roller and having a smaller diameter than that of the large diameter portion, the small diameter being rotatably supported; and a power supply configured to supply a transfer current between the first transfer roller and the second transfer roller through an electrical path formed between the second transfer roller and the conductive roller via the shaft of the first transfer roller, wherein a width of the large diameter portion of the conductive roller with respect to a width direction intersecting a direction of movement of the belt member is equal to or greater than a width of a maximum image formation area, and smaller than any one of a width of the elastic layer of the first transfer roller, a width of the elastic layer of the second transfer roller, and a width of the belt member.

13. The image forming apparatus according to claim 12, wherein the width of the large diameter portion of the conductive roller is greater than a width of the elastic layer of the first transfer roller.

14. The image forming apparatus according to claim 12, wherein the elastic layer of the first transfer roller contains an ion conductive agent and the elastic layer of the second transfer roller contains carbon.

15. The image forming apparatus according to claim 12, wherein the power supply is configured to apply a voltage having a polarity opposite to a charging polarity of toner to the conductive roller, and supply the transfer current to the second transfer roller through the shaft of the first transfer roller.

16. The image forming apparatus according to claim 12, wherein the width of the large diameter portion of the conductive roller is smaller than a width of the elastic layer of the first transfer roller.

17. The image forming apparatus according to claim 12, wherein a width of the conductive roller with respect to the width direction intersecting the direction of movement of the belt member is smaller than any one of a width of the first transfer roller, a width of the second transfer roller, and the width of the belt member.

18. An image forming apparatus comprising:

a belt member provided movably and configured to bear a toner image;

a toner image forming unit configured to form the toner image on the belt member;

a transfer roller comprising a metal shaft and an elastic layer formed on a circumference of the metal shaft, the transfer roller being in contact with a surface of the belt member and configured to receive a transfer current for transferring the toner image formed on the belt member to a recording material;

a conductive roller configured to abut against an outer circumferential surface of the transfer roller, the conductive roller comprising a large diameter portion provided at a position corresponding to an image forming area, and small diameter portions arranged at both end portions of the conductive roller and having a smaller diameter than that of the large diameter portion, the small diameter portions being rotatably supported; and a power supply configured to supply the transfer current to the transfer roller through an electrical path formed between the belt member and the conductive roller via the shaft of the transfer roller, wherein a width of the large diameter portion of the conductive roller with respect to a width direction intersecting a direction of movement of the belt member is equal to or greater than a width of the maximum image formation area, and smaller than a width of the belt member.

19. The image forming apparatus according to claim 18, wherein the width of the large diameter portion of the conductive roller is greater than a width of the elastic layer of the transfer roller.

20. The image forming apparatus according to claim 18, wherein the width of the large diameter portion of the conductive roller is smaller than a width of the elastic layer of the transfer roller.

* * * * *